US005114279A

United States Patent [19]

Bjerngren et al.

[11] Patent Number: 5,114,279

[45] Date of Patent: May 19, 1992

[54] DEVICE FOR SETTING A ROCK BOLT

[75] Inventors: Jan Bjerngren, Sollentuna; Sven Eriksson; Lars Persson, both of Örebro, all of Sweden

[73] Assignee: Atlas Copco Construction and Mining Technique AB, Stockholm, Sweden

[21] Appl. No.: 721,114

[22] Filed: Jun. 26, 1991

[30] Foreign Application Priority Data

Jul. 10, 1990 [SE] Sweden ..... 9002399

[51] Int. Cl.[5] ..... E21D 20/00

[52] U.S. Cl. ..... 405/303; 405/259.1

[58] Field of Search ..... 405/259, 260, 261, 303, 405/259.1; 173/22, 38, 39, 42; 175/52, 315

[56] References Cited

U.S. PATENT DOCUMENTS

| | | | |
|---|---|---|---|
| 4,158,520 | 6/1979 | Prebensen | 405/260 |
| 4,226,559 | 10/1980 | Prebensen | 405/303 |
| 4,473,325 | 9/1984 | Beney et al. | 405/303 |
| 4,832,536 | 5/1989 | Spross et al. | 405/303 |

*Primary Examiner*—David H. Corbin

*Attorney, Agent, or Firm*—Eric Y. Munson; Mark P. Stone

[57] ABSTRACT

Device for setting a rock bolt. The device is provided with a bolt magazine (6) arranged on a feed beam (1). Rock bolts (8) are transferred from the bolt magazine to the setting position in line with a hole drilled in the rock by means of a swingable arm (9) and displacement of a bolt setting machine (5).

1 Claim, 4 Drawing Sheets

DEVICE FOR SETTING A ROCK BOLT

BACKGROUND OF THE INVENTION

The present invention relates to a device for setting a rock bolt. The invention specially relates to a bolt magazine and those devices which are used for transferring the rock bolt from the magazine to the position for insertion into a drilled hole.

In prior art devices of the above mentioned kind, see U.S. Pat. No. 4,215,953, a magazine is used which comprises means for moving a bolt into line with the bolt setting machine.

SUMMARY OF THE INVENTION

The present invention, which is defined in the subsequent claims, aims at achieving a bolt setting device which is light and thus possible to use over a large area from one position of the carrier. This is achieved by means of the characteristics given in claim 1

BRIEF DESCRIPTION OF THE DRAWINGS

An embodiment of the invention is described below with reference to the accompanying drawings in which.

BEST MODES FOR CARRYING OUT THE INVENTION

Figure 8:
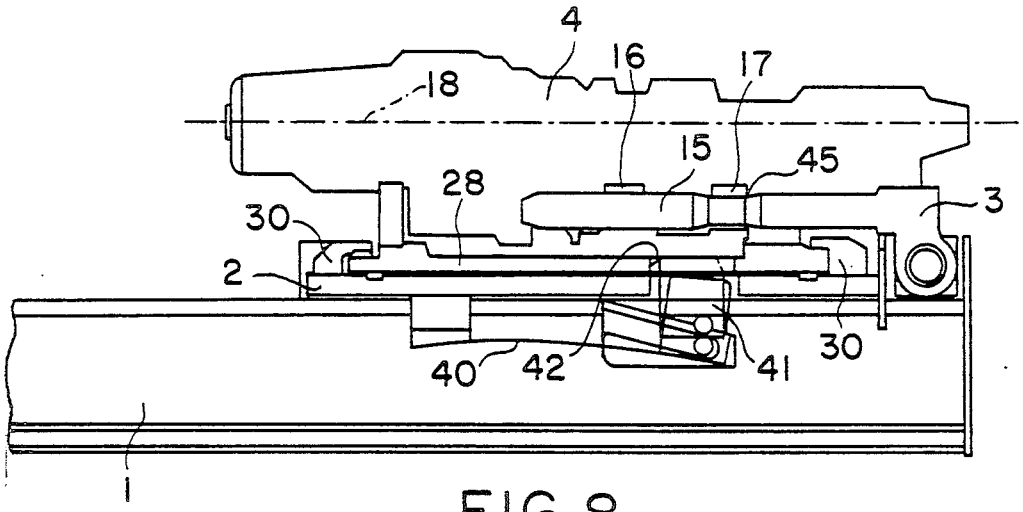
FIG. 8 shows the rear part of the feed beam of the rock bolting rig with a rock drilling machine entered on the slide.
Figure 9:
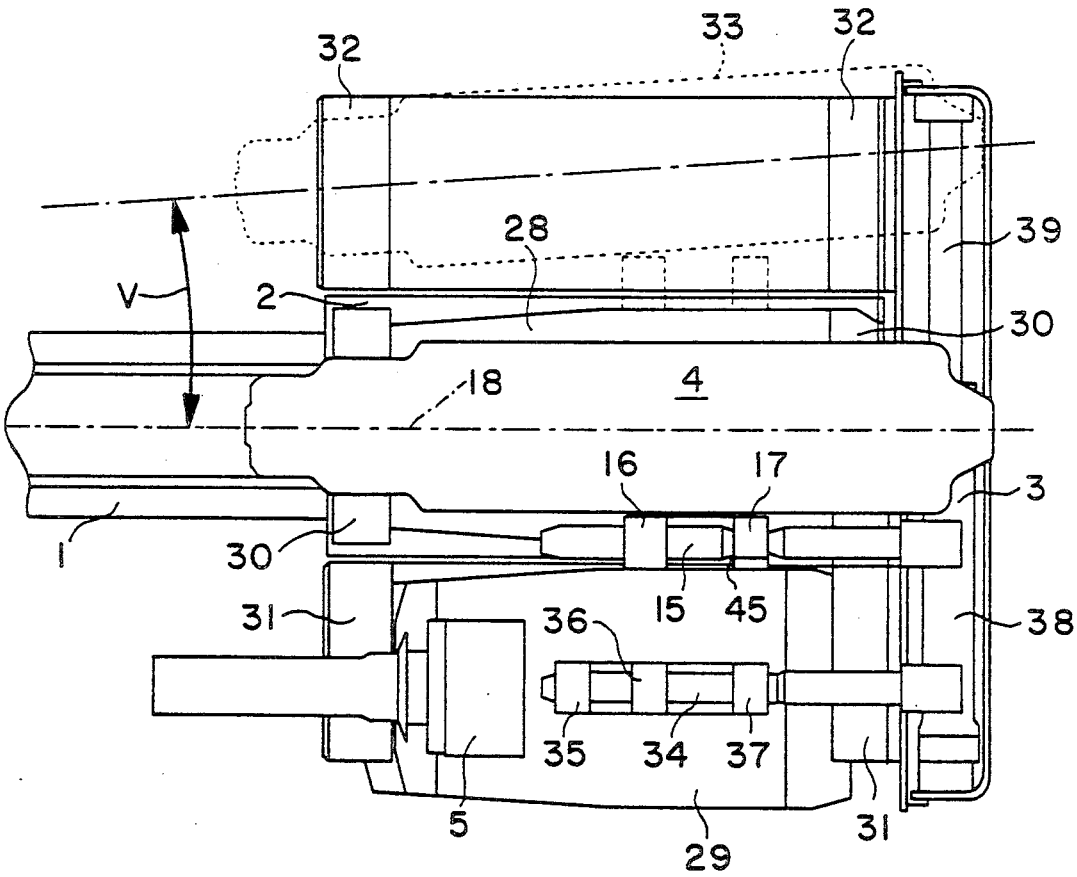
FIG. 9 shows the device according to FIG. 8 seen from above.

The device shown in the drawings comprises a feed beam 1 carried by a feed beam carrier 23 The feed beam carrier is carried by a not shown boom on a not shown carrier. The feed beam carrier 23 is by means of a hydraulic cylinder 25 swingable relative to the boom The feed beam 1 is by means of a hydraulic cylinder 24 displaceable relative to the feed beam carrier 23. At the front end of the feed beam 1 a support 19 is arranged for application against a rock surface. At the front end of the feed beam is furthermore a swingable drill guide 11 arranged. The drill guide 11 comprises a guide 20 for a drill rod 43 and a guide 21 for an injection device 44. The guide 20 can be opened by means of a hydraulic cylinder 22 to allow the swinging out of drill guide 11 without taking the drill rod with it At the rear end of feed beam 1 two brackets 26 and 27 are mounted. These brackets are meant for carrying a rock drilling machine 4 and a bolt setting machine 5 respectively in their rest positions A slide 2 is in a usual manner displaceable along the feed beam 1 to feed the rock drilling machine 4 or the bolt setting machine 5 towards or from the rock. The rock drilling machine 4 is arranged on an upper slide 28 The bolt setting machine 5 is arranged on an upper slide 29. Slide 2 is provided with angular pieces 30 in order to hold the rock drilling machine 4 or the bolt setting machine 5 longitudinally on slide 2. Bracket 26 is provided with angular pieces 32 for holding rock drilling machine 4 longitudinally in its rest position on bracket 26 Bracket 27 is provided with angular pieces 31 in order to hold bolt setting machine 5 longitudinally in its rest position on bracket 27. At the rear end a machine switch 3 is arranged for movement of the rock drilling machine 4 between the rest position on bracket 26 and the working position on slide 2. The machine switch is at the same time used for movement of the bolt setting machine 5 between its working position on slide 2 and its rest position on bracket 27. The upper slide 28 is provided with two guides 16 and 17, which thus are related to the rock drilling machine 4, for cooperation with displacement means 15 arranged on the machine switch 3. Upper slide 29 is provided with three guides 35, 36 and 37 for cooperation with a transfer means 34 arranged on the machine switch 3. Machine switch 3 comprises a hydraulic cylinder 38 with a through piston rod 39 which is fixed between the outer ends of brackets 26, 27. Slide 2 is provided with a dowel 41 which is arranged on a spring 40. When the slide is in the position shown in FIG. 8 the dowel is in its lower position so that upper slide 28 or 29 can be displaced sideways. When the slide is fed forwards towards the rock spring 40 will move the dowel 41 into a hole 42 in the upper slide which through this is prevented from sideways displacement. Displacement means 15 is provided with a reduction 45 which makes it possible for the rock drilling machine to tilt an angle v relative to the direction of movement 18 of slide 2 when moved to the rest position. This tilt is of the order of a few degrees and has as purpose to decrease the bending loads on the drill rod 43. The magnitude of the angle depends on the sideways movement of rock drilling machine 4, the swinging out of guide 20 and the length of the feed beam. The tilted position is marked by the number 33 in FIG. 9

Figure 7:
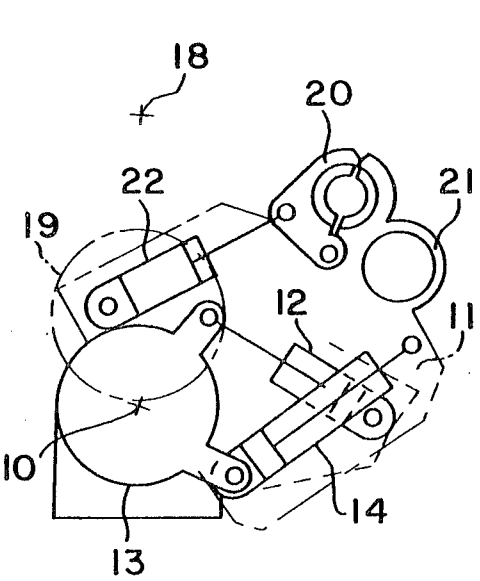
FIG. 7 shows the drill guide swung away for insertion of a rock bolt.
Figure 6:
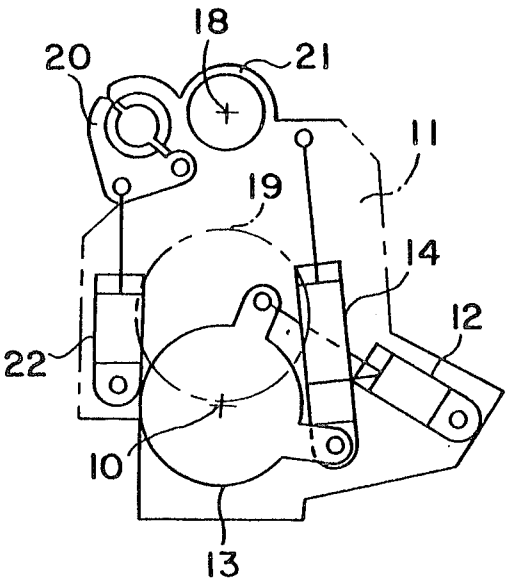
FIG. 6 shows the drill guide in position for injection.
Figure 5:
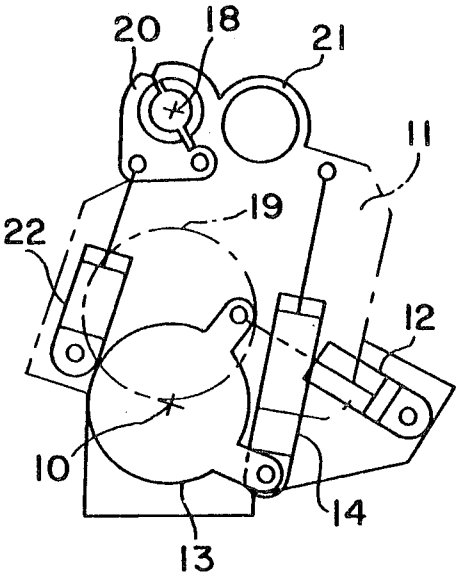
FIG. 5 shows schematically a drill guide in position for drilling.

The build-up and functioning of the swingable drill guide 11 is best shown in FIGS. 5-7. The drill guide comprises a plate 11 which is swingable about an axis 10. Guide 20 for drill rod 43 and guide 21 for injection device 44 are arranged on plate 11. A hydraulic cylinder 12 is arranged between feed beam 1 and attachment 13 which is rotatably journalled about axis 10. A hydraulic cylinder 14 is arranged between attachment 13 and plate 11. By means of hydraulic cylinder 12 the attachment 13 and thus plate 11 can be indexed between a drilling position, FIG. 5, and an injection position, fig 6. By means of hydraulic cylinder 14 plate 11 can be swung away, FIG. 7, so that a rock bolt 8 can be moved past the drill guide into the drilled hole in the rock. Since the two hydraulic cylinders 12 and 14 are connected in series it is made possible to achieve a large swinging out of plate 11 with a compact design.

Figure 1:
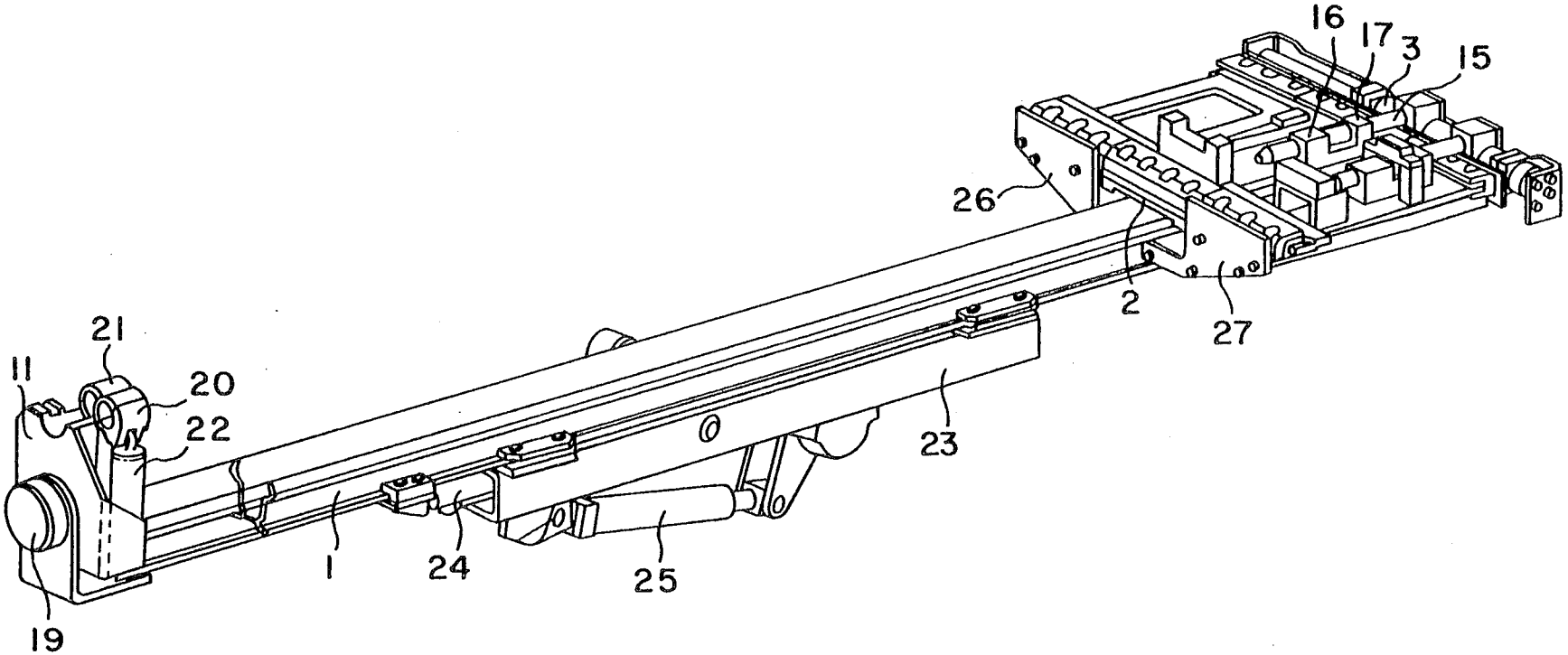
FIG. 1 shows a part of a rock bolting rig in perspective.
Figure 4:
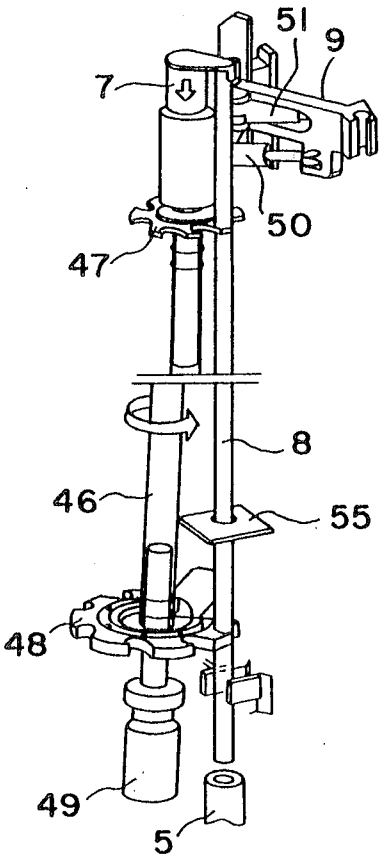
FIG. 4 shows on a larger scale a part of the device according to FIG. 2.
Figure 3:
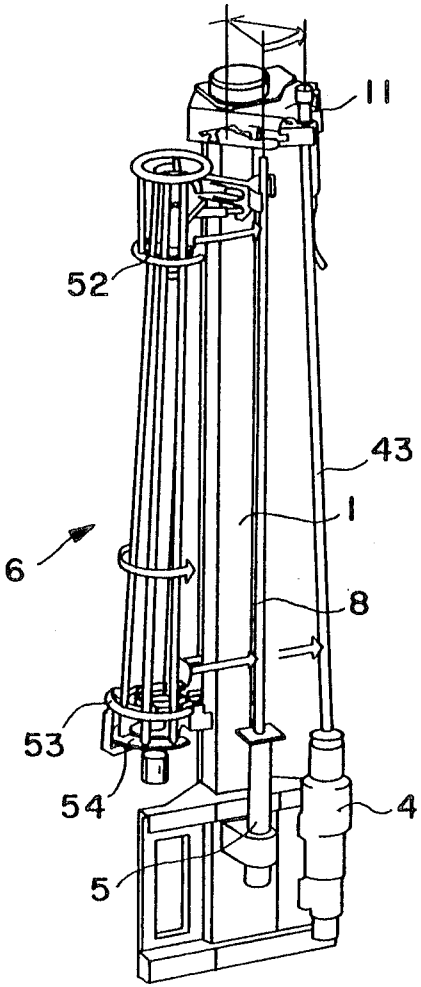
FIG. 3 shows the same part in position for insertion of a rock bolt.
Figure 2:
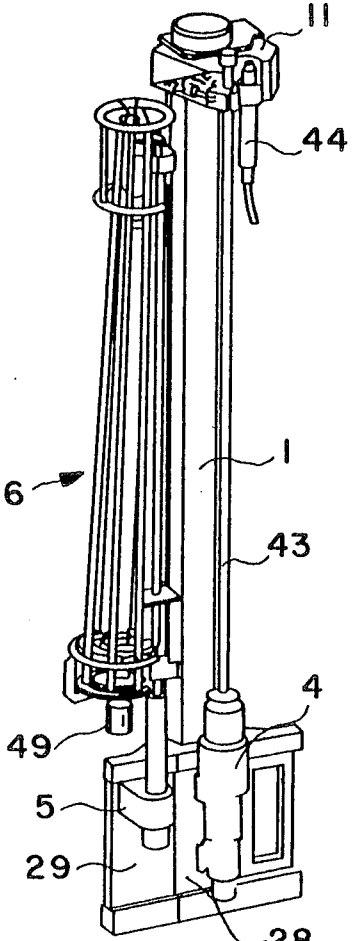
FIG. 2 shows a part of the rock bolting rig in position for drilling.

A bolt magazine 6 for rock bolts 8 is secured to feed beam 1. The rock bolts have plates 55 for contact against the rock surface. The bolt magazine is built up around a shaft 46 which is rotatable by means of a motor 49. Shaft 46 is provided with discs 47 and 48 having recesses which hold the rock bolts 8 separated. In order to prevent the rock bolts from falling out of the magazine this is provided with bows 52 and 53 at the height of the discs. The bolts rest in the magazine on a support 54. The bolt magazine is provided with a finger 7 by means of which a rock bolt 8 can be pushed into the chuck of the bolt setting machine 5 when it is in its rest position fig 2. The device is provided with an arm 9 which by means of a hydraulic cylinder 50 is swingable for transferring a rock bolt from the magazine to a position in line with an earlier drilled hole in the rock. The arm is provided with a hydraulic cylinder 51 by means of which the rock bolt can be gripped. At the same time as the arm 9 swings over from the bolt magazine to the setting position the bolt setting machine 5 is displaced from the position in FIG. 2 to the position in FIG. 3. In order to achieve a device which has small dimensions at the rock surface shaft 46 is arranged at an angle relative to the moving direction of slide 2. This gives a conical magazine where the rock bolt which has been rotated to the position for being pushed into the bolt setting machine 5 is parallel with the direction of movement of slide 2.

The above descrived device works in the following way Support 19 is applied against the rock. Bolt magazine 6 is rotated so that a rock bolt is aligned with the bolt setting machine 5 when it is in its rest position FIG. 2. Finger 7 is activated to push a rock bolt into bolt setting machine 5. Arm 9 is brought to grip the rock bolt. With the rock drilling machine 4 and the drill guide 11 in position for drilling, FIG. 2 drilling starts whereby slide 2 is fed along feed beam 1. When the drilling has been finished the drilling machine is returned. Then drill guide 11 is indexed to the position according to FIG. 6 By means of injection device 44, which is connected to a compressed air source for the feeding in of resin cartridges or to a supply of grout, resin cartridges or grout is supplied Then drill guide 11 is swung away. Arm 9 is swung and the bolt setting machine is entered onto slide 2 so that the rock bolt comes into line with the drilled hole. At the same time the rock drilling machine is moved away to its rest position tilting upper slide 28 so as to decrease the bending load on drill rod 43. Then slide 2 with bolt setting machine 5 is fed towards the rock for setting of the rock bolt. Then the bolt setting machine is returned and a new work cycle can begin.

We claim:

1. Device for setting a rock bolt comprising a feed beam (1), a slide (2) movable to-and-fro along the feed beam, a machine switch (3) by means of which a rock drilling machine (4) or a bolt setting machine (5) is movable between a first rest position and a first working position on said slide (2) at the same time as the other of said machines is movable between a second working position on said slide and a second rest position, each of said machines having a working position on said same slide; said device further including a bolt magazine (6) arranged on said feed beam (1), a finger (7) by means of which a rock bolt (8) can be inserted into said bolt setting machine (5) when the bolt setting machine is in its said rest position, and a swingable arm 9; said swingable arm (9) and said bolt setting machine (5) being arranged to transfer the rock bolt (8) from said bolt magazine (6) to a setting position.

* * * * *